United States Patent [19]

Johnson, Jr.

[11] 4,224,890

[45] Sep. 30, 1980

[54] BACKSTAY TENSIONING DEVICE

[75] Inventor: Curtiss S. Johnson, Jr., Middle Haddam, Conn.

[73] Assignee: C. Sherman Johnson Co., Inc., East Haddam, Conn.

[21] Appl. No.: 934,975

[22] Filed: Aug. 18, 1978

[51] Int. Cl.[3] ..... B63H 9/08

[52] U.S. Cl. ..... 114/109; 254/399

[58] Field of Search ..... 254/188, 192; 114/102, 114/109; 294/78 R, 78 A

[56] References Cited

U.S. PATENT DOCUMENTS 1,968,321 7/1934 Shope ..... 254/192

OTHER PUBLICATIONS

"Turnbuckles", 1971 Land's End Yachtman's Equipment Guide, p. 218.

*Primary Examiner*—Charles E. Phillips

*Attorney, Agent, or Firm*—McCormick, Paulding & Huber

[57] ABSTRACT

A self-contained tensioning device for adjusting the tension of a backstay cooperates with a bridle which connects the backstay to the transom of a sailboat. The device includes a pair of plates having sheaves rotatably mounted between the plates to form a passageway for the bridle cables and a block and tackle for adjusting the plates and sheaves along the bridle cables relative to the transom. By varying the position of the plates and sheaves along the bridle, the spacing between the bridle cables is decreased or increased and the tension in the backstay is adjusted.

5 Claims, 5 Drawing Figures

FIG. 5
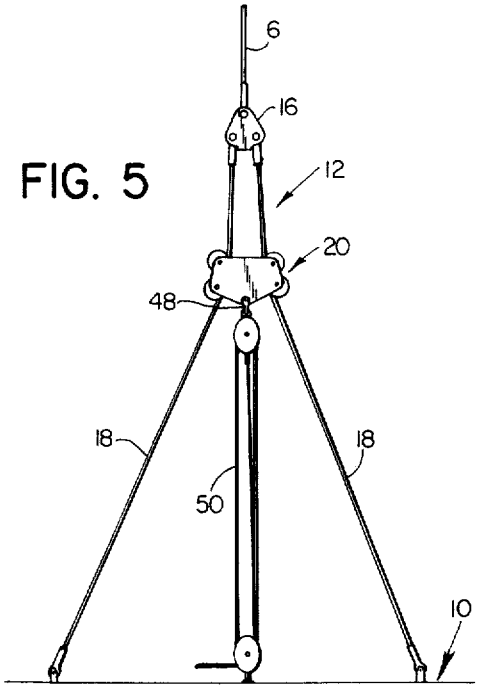
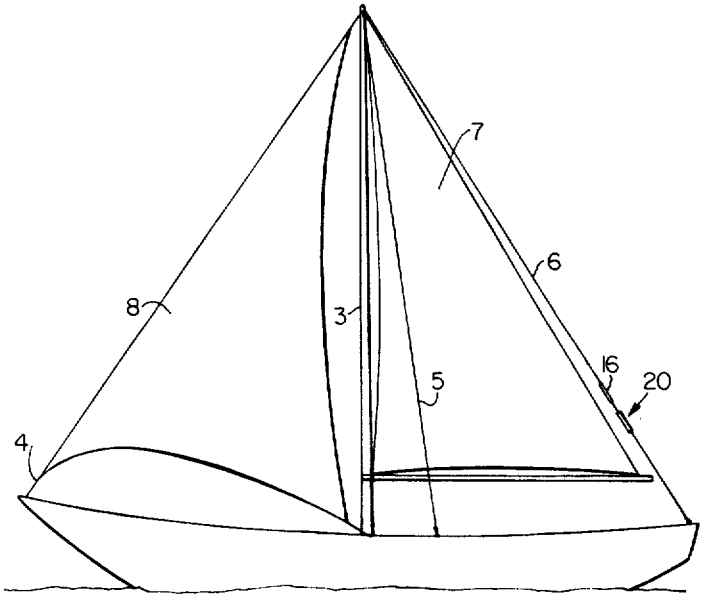
FIG. 1
FIG. 4
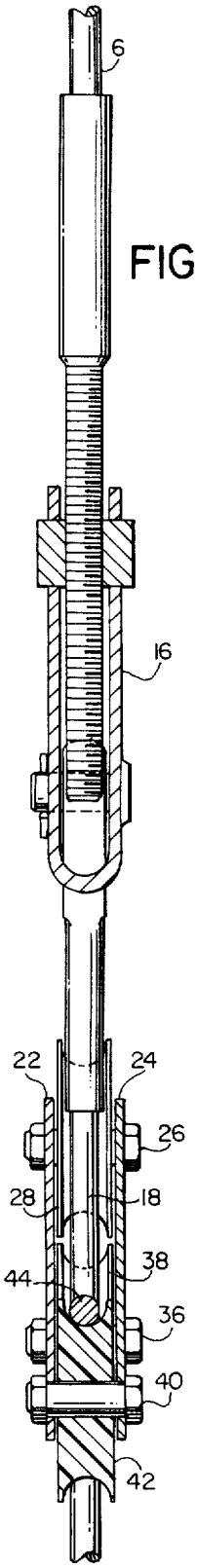

BACKSTAY TENSIONING DEVICE

BACKGROUND OF THE INVENTION

This invention relates to sailboats, and more particularly to means for adjusting the tension in a backstay of the type being connected to the transom by means of a bridle.

The mast of larger sailboats is supported by a headstay which slants toward the fore portion of the boat, sidestays and a backstay which slants toward the aft portion of the boat. The backstay is adjusted to vary the tension in the other stays and thereby control the amount of sag in the rigging when the sail is under load, such as when the sailboat is going to weather. Increased tension in the stays increases the compression load on the mast and permits the sail shape to be varied.

It is often necessary to change backstay tension during sailing to vary the sail shape and sag in the rigging. In the past backstay tension has been adjusted by blocks mounted on each of the cables of the backstay bridle and interconnected by a ring on which a third block is mounted. A disadvantage of using the blocks is that they produce a large wrap angle in the cables of the bridle and cause bending and fatigue within the cables.

Also, the prior art devices are relatively expensive because they require assembly of a number of individual, general purpose components in a unit rather than one self-contained article designed for the tensioning function.

SUMMARY OF THE INVENTION

This invention relates to a backstay tensioning device which provides an easy means for increasing or decreasing backstay tension during all sailing conditions.

The tensioning device is a self-contained integral unit which cooperates with bridle cables connected between the backstay and transom. The device has sheaves held between two mounting plates, and as the sheaves move along the bridle cables relative to the transom, they increase or decrease the spacing between the bridle cables and produce a corresponding decrease or increase in the tension of the backstay.

The unit is preferably provided with pairs of sheaves for each of the bridle cables to reduce the bending angle of the bridle cables and the amount of fatigue experienced by cables during adjustment.

BRIEF DESCRIPTION OF THE DRAWINGS

These and other aspects of the invention will be more fully understood by referring to the following detailed description and the accompanying drawing, in which:

FIG. 1 is a side elevation view of a sailboat which utilizes the backstay tensioning device of the present invention.

FIG. 4 is a longitudinal cross sectional view of the backstay tensioning device being generally taken along the line and in the direction of the arrows 4—4 of FIG. 3.

FIG. 5 is an aft elevational view of a second embodiment of the backstay tensioning device.

DESCRIPTION OF THE PREFERRED EMBODIMENTS

Figure 2:
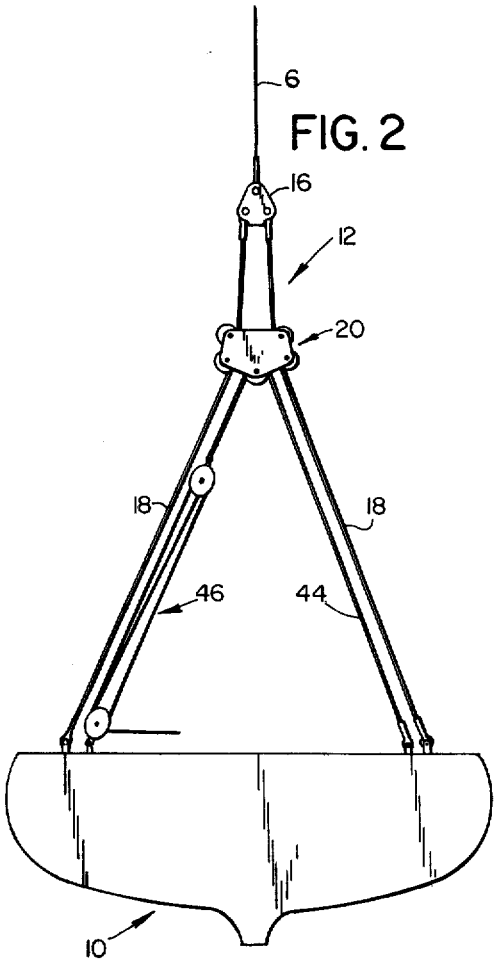
FIG. 2 is a rear elevational view of the sailboat showing a first embodiment of the backstay tensioning device of this invention.

Turning now to the drawings in greater detail, FIG. 1 shows a sloop rigged sailboat 2 having a mast 3 supported by a headstay 4, two sidestays 5 (only one visible) and a backstay 6. A mainsail 7 is attached aft of the mast 3 and a jib 8 to the headstay forward.

FIG. 2 is a rear view showing the transom 10, of the sailboat and a backstay rigging, indicated generally at 12, of the type which permits use of either an outboard motor a or an outboard rudder without interference with the rigging. In this rigging, the backstay 6 is attached at its upper end to the mast (not shown) and at its lower end to a backstay yoke 16. A pair of bridle cables 18, 18 are attached at their upper ends to the yoke 16 and at their lower ends to the outboard sides of the transom 10 to form a substantially triangular space between the bridle cables 18, 18 and the transom 10 through which a tiller may extend. The backstay tensioning device of the present invention, indicated generally at 20, is slidably mounted on the bridle cables 18, 18.

Figure 3:
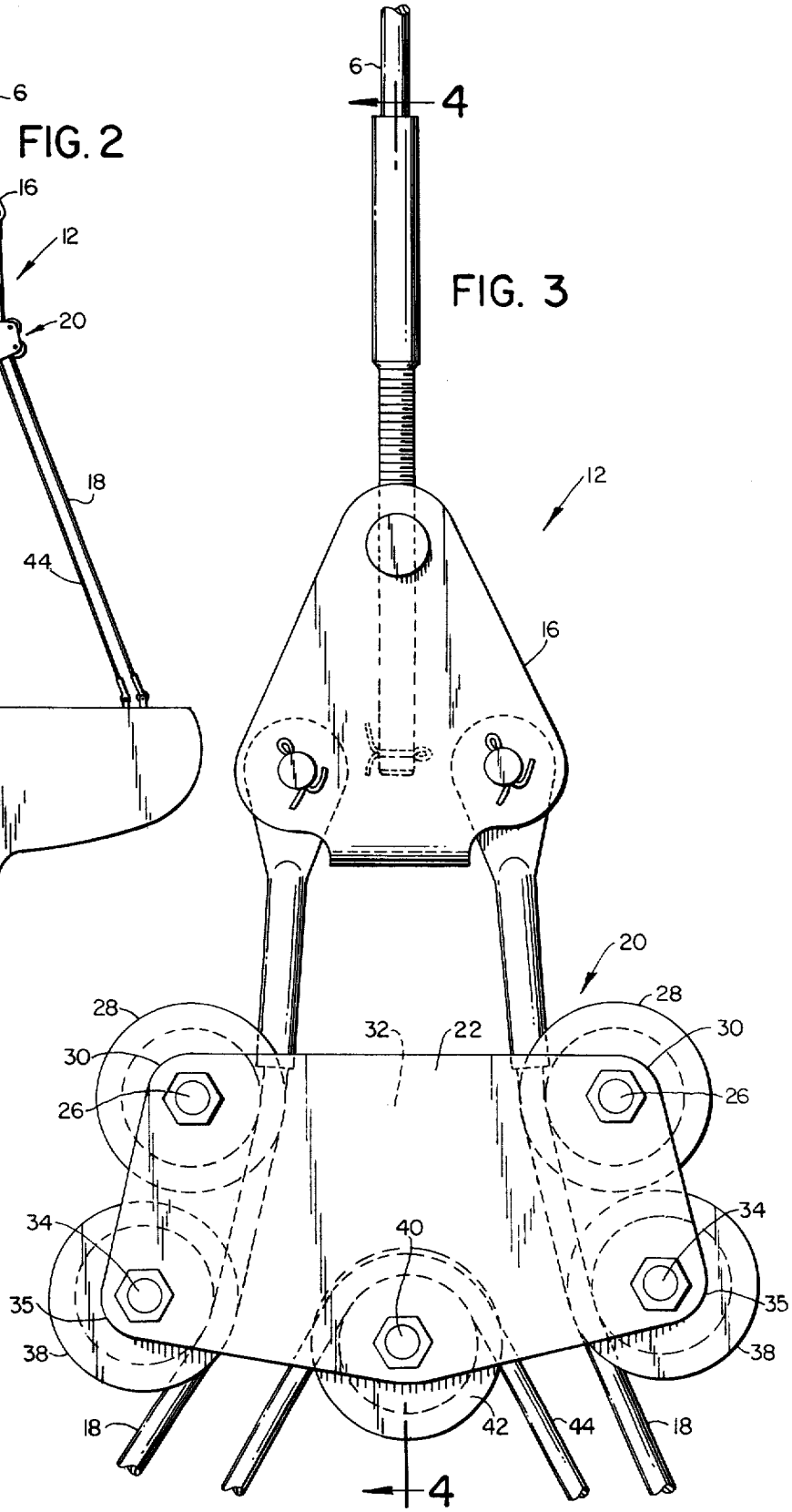
FIG. 3 is an enlarged view of the backstay tensioning device at the junction of the backstay and bridle.

Referring now in particular, to FIGS. 3 and 4, the backstay tensioning device 20 is described in detail. The tensioning device 20, is a self-contained unit, and includes a pair of substantially rectangular, mounting plates 22 and 24 extending in parallel relationship from the outboard side of one bridle cable to the outboard side of the other bridle cable. The plates 22 and 24 are positioned respectively fore and aft of the bridle and are preferably constructed of a rigid metallic material such as stainless steel. The plates are interconnected at their upper most corners 30, 30 by means such as bolts 26, 26 which rotatably support a pair of sheaves 28, 28 respectively. At the lower most corners 35, 35 the plates are interconnected by bolts 34, 34 which rotatably support a second pair of sheaves 38, 38 respectively. The sheaves 28, 28 and 38, 38 are preferably constructed of a synthetic plastic material such as DELRIN, a product manufactured by Dupont, or aluminum.

As best shown in FIG. 3 sheaves 28, 28 and 38, 38 and the plates 22, 24 form an inner passageway 32 to receive the bridle cables 18, 18. The sheaves 28, 28 are disposed along the passageway remotely from the respective sheaves 38, 38 and each pair of sheaves is disposed symmetrically on opposite sides of the bridle passageway 32. The spacing between the sheaves 28, 28 is less than the spacing between the sheaves 38, 38 so as to reduce the bending angle and flexing of the bridle cables 18, 18 as the plates and sheaves are moved along the cables. The amount of wear and fatigue of the bridle cables 18, 18 is reduce correspondingly.

A bolt 40, also extends between the plates at their lower edge intermediate the sheaves 38, 38, and a down haul sheave 42, is rotatably mounted on the bolt 40 between the plates 22, 24.

As best shown in FIG. 2 a standing wire 44 having one of its ends connected to the transom 10 passes between the plates 22, 24 and over the down haul sheave 42 and is attached at its other end to a block and tackle assembly 46, which is also connected to the transom 10. The block and tackle assembly 46 and standing wire 44 comprise means for adjusting the position of the plates and sheaves along the bridle cables and correspondingly the tension in the backstay. It will be seen that by pulling on the free line of the block and tackle assembly 46 that the plates and sheaves are drawn downwardly toward the transom 10 along the bridle cables 18, 18 so as to reduce the spacing between the cables 18, 18. At the same time, the tension on the backstay 6 increases.

It will also be seen that by relaxing the block and tackle assembly 46 the plates and sheaves are pulled away from the transom 10 along the bridle cables 18, 18 by the tension on the backstay 6 and bridle cables 18, 18, and the tension on the backstay 6 is correspondingly decreased.

Turning now to FIG. 5 another means is shown for adjusting the position of the plates and sheaves of the tensioning device 20 toward and away from the transom 10 along the bridle cables 18, 18. In this embodiment of the invention the plates and sheaves are the same as shown in FIGS. 3 and 4, but a block and tackle assembly 50 extends directly between a becket 48 attached to the plates intermediate the cable passage and the transom 10 without the aid of the standing wire 44 or the down haul sheave 42 in FIG. 2. Thus the amount of purchase is reduced but the rate of adjustment increases correspondingly.

It will be seen in FIG. 5 that by pulling on the free line of the tackle assembly 50 the plates and sheaves move toward the transom 10 and increase the tension on the backstay 6, and that by relaxing the tackle assembly, the plates and sheaves move away from the transom 10 and decrease the tension on the backstay.

While the backstay tensioning device has been described in several embodiments, it will be understood that other modifications and substitutions can be made without departing from the spirit of the invention. For example, it will be apparent that the plates 22, 24 and associated sheaves can be adjustably positioned along the bridle cables by winches and means other than the block and tackle assemblies. Accordingly, the present invention has been described in a preferred embodiment by way of illustration rather than limitation.

I claim:

1. A backstay device for adjusting the tension of a backstay mounted by means of bridle cables to the transom of a sailboat comprising: first and second mounting plates, the first of said plates extending from the outboard side of one of the bridle cables to the outboard side of the other of the bridle cables at a position aft of the bridle cables, the second of said plates extending from the outboard side of one of the bridle cables to the outboard side of the other of the bridle cables at a position forward of the bridle cables in parallel relationship with the first of said plates; a first pair of sheaves being rotatably mounted between said plates and spaced from each other so as to define a bridle passageway between said sheaves and plates to accept said bridle cables; a second pair of spaced sheaves rotatably mounted between said plates and located respectively on opposite sides of the bridle passageway defined between the first pair of sheaves and mounting plates, the second pair of sheaves being disposed along the passageway remotely from the first pair of sheaves and having a spacing different from the spacing of the first pair to reduce the bending angle of the bridle cables in the passageway; and means for adjusting the position of the plates and sheaves along the bridle cables relative to the transom whereby the spacing between said bridle cables is decreased or increased to adjust the tension of the backstay.

2. A backstay tensioning device as defined in claim 1 wherein said means for adjusting the position of the plates and sheaves comprises a block and tackle extending between the pair of mounting plates and the boat transom.

3. A backstay tensioning device as defined in claim 2 wherein said means for adjusting the position of the plates and sheaves along the bridle cable relative to the transom further includes an additional sheave rotatably mounted between said mounting plates and a cable extending over the additional sheave and connected at one of its ends to the transom and at its other end to the block and tackle attached to the transom.

4. A backstay tensioning device as defined in claim 1 wherein the rotatable sheaves are disposed symmetrically on opposite sides of the bridle passageway and the means for adjusting the plate positions is coupled to the plates at an intermediate position in the passageway.

5. A backstay adjusting device as defined in claim 1 wherein said means for adjusting the position of the plates and sheaves along the bridle cable relative to the transom comprises a becket pivotally mounted to the plates and sheaves and a block and tackle assembly extending between the transom and the becket.

* * * * *